US005489164A

United States Patent [19]

Tusch et al.

[11] Patent Number: 5,489,164

[45] Date of Patent: Feb. 6, 1996

[54] METHOD OF CONNECTION

[75] Inventors: Klaus N. Tusch, London; John F. K. Thompson, Flokestone, both of United Kingdom

[73] Assignee: Colebrand Limited, London, United Kingdom

[21] Appl. No.: 300,593

[22] Filed: Sep. 2, 1994

Related U.S. Application Data

[63] Continuation of Ser. No. 52,892, Apr. 26, 1993, abandoned.

[30] Foreign Application Priority Data

Apr. 27, 1992 [GB] United Kingdom ..... 9209063

[51] Int. Cl.[6] ..... E21D 11/08

[52] U.S. Cl. ..... 405/152; 52/396.06; 52/393; 404/74; 405/151

[58] Field of Search ..... 405/152, 107, 405/303, 151; 52/396.06, 393, 396.02; 404/74

[56] References Cited

U.S. PATENT DOCUMENTS

| | | | |
|---|---|---|---|
| 935,376 | 9/1909 | Lennon | 405/152 |
| 1,881,421 | 10/1932 | Coyle | 405/152 |
| 2,333,826 | 11/1943 | Smith et al. | 405/152 |
| 3,695,044 | 10/1972 | Hoshino et al. | 405/152 |
| 4,655,638 | 4/1987 | Waring | 405/152 |

FOREIGN PATENT DOCUMENTS

| | | | |
|---|---|---|---|
| 0340659 | 11/1989 | European Pat. Off. | 405/152 |
| 1079091 | 4/1960 | Germany | 405/152 |
| 7908161 | 3/1980 | Netherlands | 405/152 |

*Primary Examiner*—Dennis L. Taylor
*Attorney, Agent, or Firm*—Emrich & Dithmar

[57] ABSTRACT

The invention relates to a constructional element such as a tunnel lining, part of which is shown in the drawing, comprising adjacent segments which have facing surfaces between which there is a joint which is physically deformable under load. The joint comprises a toroidal body or tube of substantially circular cross section received in complementary or semi-circular facing recesses in the surfaces respectively, and comprises a flexible material such as polypropylene and which means in the form of a nozzle for gaining access to the interior of the body. The body is initially filled with a fluid, which could be a liquid or gas, through the nozzle, which can then be maintained in the body by closing the nozzle as by a valve. When round in which the tunnel is set has settled, the joint is "locked up" by passing a flowable settable material such as a cementitious mortar material from a grout pump into the body, which thereby displaces the fluid which passes out of the body through an outlet which may be part of the nozzle, may be a separate nozzle, or may be the bleed valve.

9 Claims, 1 Drawing Sheet

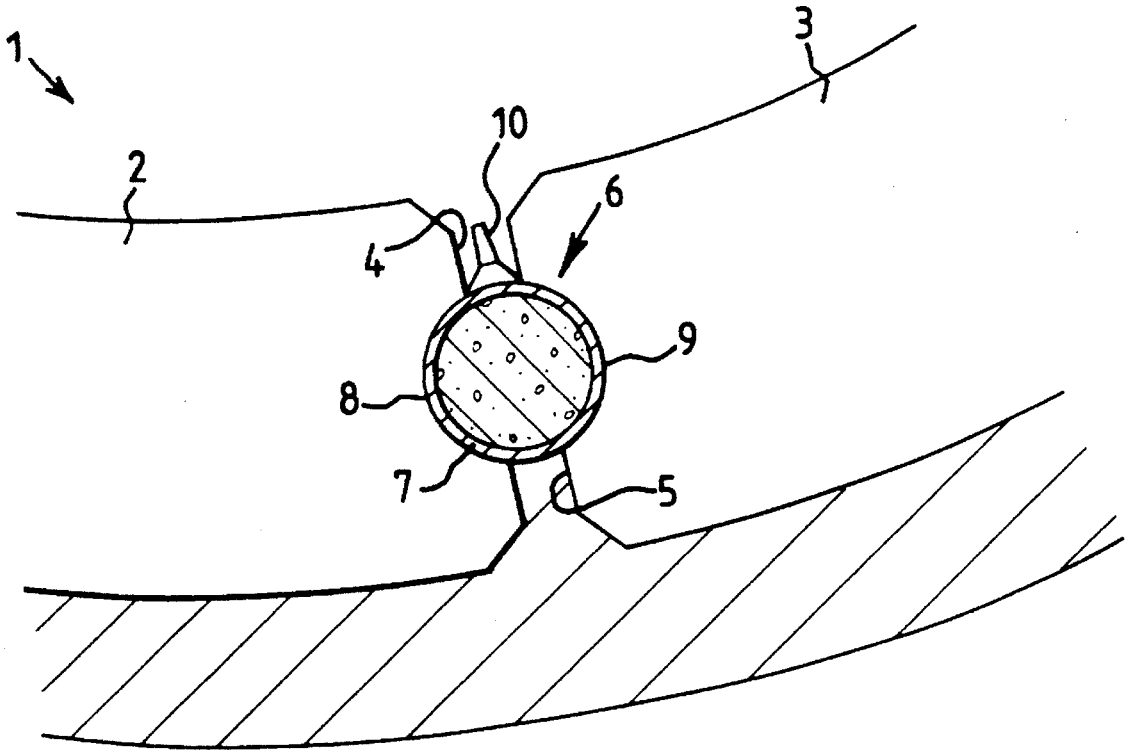
1
2
3
4
5
6
7
8
9
10

METHOD OF CONNECTION

This is a continuation of application Ser. No. 08/052,892 of Apr. 26, 1993 now abandoned.

BACKGROUND OF THE INVENTION

The invention relates to a method of connection, particularly to improvements in methods of connection of segmental concrete linings, of for example, a tunnel.

Segmented rings of preformed concrete provide an immediate permanent lining of great strength for tunnels provided that they can be brought into close contact with the ground by grouting or otherwise. The lining segments are usually joined by radial knuckle or seat joints.

It will be understood that there are generally two basic forms of tunnel linings. The two forms are bolted and boltless. The bolted lining is relatively rigid, whereas the boltless is relatively more flexible. The radial (seat) joints in both forms have no yielding contact areas, and in that sense are rigid. Because of this, in swelling or creepling ground rock, failure of linings has occurred.

SUMMARY OF THE INVENTION

It is accordingly an object of the invention to seek to mitigate this disadvantage.

According to a first aspect of the invention there is provided a method of joining two adjacent segments of a constructional member, comprising providing in use facing surface of the segments with a joint which is physically deformable under load.

The method may include the step of providing a joint having a fluid component whereby the joint is rendered flexible, and by replacing the fluid with a settable material when the joint is required to be rendered substantially inflexible. This provides a method whereby settling of ground around the constructional member is accommodated prior to rendering the joint set.

The step of providing the settable material may comprise providing the joint as a toroidal member adapted to be received between facing surfaces of segments arranged to form a cylindrical member. This step provides for smooth operation and relative movement of the segments during settling.

The method may comprise the step of providing complementary recesses in the respective facing surfaces adapted to receive the toroidal member. This provides a smooth seating for the member and for close contact of the facing surface of the segments which may comprise curved segments where the constructional member is tunnel lining.

According to as second aspect of the invention provides a method of constructing a tunnel, comprising using a method as hereinbefore defined.

According to a third aspect of the invention there is provided a constructional element, comprising adjacent segments which have adjacent facing surfaces between which there is a joint which is inherently physically deformable under load.

The joint may be hollow and comprise a body of flexible material. This provides for ease of construction.

The body may comprise a flexible material and means whereby a settable material may be passed into the body to displace fluid, whereby to render the joint substantially inflexible. This provides for relatively simple replacement of the fluid with the settable material which may be a cementitious material.

The means may comprise a nozzle for inlet of fluid, and an inlet for settable material.

The body of the joint may comprise a plastic material; this provides a relatively inexpensive joint.

According to a fourth aspect of the invention there is provided a tunnel lining, comprising a constructional element as hereinbefore defined.

Thus using the invention it is possible to provide a method of joining two adjacent segments of segmental concrete tunnel lining which segments have complementary facing recesses which accommodate a flexible cylinder, comprising first filling the cylinder with a fluid and then expelling said fluid and replacing it by a cementitious settable solid after a predetermined deflection of the lining has taken place.

DESCRIPTION OF THE DRAWING

The method and constructional element embodying the invention are diagrammatically illustrated, by way of example, with reference to the accompanying drawing, which shows a cross-sectional view of a joint in accordance with the invention.

DETAILED DESCRIPTION

Referring to the drawings, there is shown a constructional element such as a tunnel lining 1, part of which is shown in the drawing, comprising adjacent segments 2 and 3 which have facing surfaces 4 and 5 between which there is a joint 6 which is physically deformable under load. The joint comprises a toroidal body or tube 7 of substantially circular cross section received in complementary or semi-circular facing recesses 8, 9 in the surfaces 4 and 5, respectively, and comprises a flexible material such as polypropylene and which has means in the form of a nozzle 10 for gaining access to the interior of the body 7.

In use, the tunnel lining 1 is necessarily installed below the ground. The ground in practice settles around the tunnel lining and this imposes a load on it and thus on the joint 6 which if rigid could be destroyed, thereby leading to loss of integrity of the lining and thus of the tunnel which could collapse.

To accommodate this, using the invention the body 7, is initially filled with a fluid, which could be a liquid or gas, through the nozzle 10, which can then be maintained in the body 7 by closing the nozzle 10 as by a valve. As the ground round the lining settles, the joint 6 physically deforms or yields according to the external pressures imposed on it, whilst maintaining the desired spatial relationship between adjacent segments 2 and 3. This deflection can be as much as 150 mm on both the X and Y axis.

When the settling has maximized, which may be determined by taking readings over a period of time, and which might be over several days or some months, and will be the deformation of the segmental ring observed by taking the pressure gauge on the nozzle 10, which than acts as a bleed valve, or on a separate bleed valve carried by the body 7. The joint 6 is "locked up" by passing a flowable settable material such as a cementitious mortar material 11 from a grout pump into the body, which thereby displaces the fluid which passes out of the body 7 through an outlet which may be part of the nozzle 10, may be a separate nozzle, or may be the bleed valve. The cementitious mortar 11, a high strength fine concrete, for example, completely fills the body 7 in the deformed joint 6 and thus when it sets produces a rigid articulated joint between the segments 2 and 3 in their "settled" position. The tunnel lining 1 is thus secured in its final rest position with its physical integrity intact.

Using a method and constructional elements as herein described with reference to the drawing, a tunnel lining may be installed which moves as ground in which it is installed, swelled and/or creeps, as is usually the case initially, and which can then be locked up by replacing the fluid with which the body is inflated with a flowable, settable cement.

It will be understood that there may be modifications. For example, the body 7 may include a pressure relief valve for allowing fluid to be expelled from the body without rupturing the same should the imposed pressure from the ground movement become excessive.

It will also be understood that the invention provides a method of tunnel lining which is flexible and adaptable, and which can be varied to suit changes in ground conditions.

Thus, there is provided a preformed segmental lining in which the degree of flexibility of the lining can be adjusted to suit ground conditions. The basic joint is a radial knuckle joint. The radial (seat joint) has a concave recess formed in it which can accommodate a rigid, plastic or flexible cylinder. Thus the invention can:

a) use a rigid cylinder of high strength fine concrete. This produces a usual articulated jointed segmental lining;

b) use nylon or similar plastic cylinder which produces a usual articulated jointed lining with the added flexibility of "creeping" contact area between adjacent segments; and c) use a flexible cylinder, initially filled (inflated) with a liquid gas which produces a yielding joint.

When most of the deflection has taken place, the liquid or gas will be replaced by a cementitious mortar to produce a conventional articulated joint.

We claim:

1. A method of connecting two adjacent segments of a constructional element, including the steps of:

providing facing surfaces of the segments with each facing surface of each segment having a complimentary recess therein;

providing a joint between said two adjacent segments, said joint comprising a hollow body position in and received by said complimentary recess and having a nozzle for introduction of fluid or settable material therein;

filling the hollow body with a fluid whereby it is rendered flexible and deformable while simultaneously maintaining a spatial relationship between said facing surfaces of the two adjacent segments;

monitoring the settling of the medium in which the constructional element is placed by monitoring the internal pressure of the fluid via said nozzle; and rendering the joint substantially inflexible by replacing said fluid with a flowable settable material, wherein the constructional element is secured in its final rest position with its physical integrity intact.

2. A method as defined in claim 1, wherein said step of rendering said joint substantially inflexible comprises passing said settable material into the joint to displace fluid from the joint.

3. A method as defined in claim 1, wherein said joint is a toroidal member receivable between the facing surfaces of segments structurally arranged to form a cylindrical element.

4. A method as defined by claim 3, further including the step of providing complementary recesses in said respective facing surface in which said toroidal member is received.

5. A method as defined in claim 1, wherein said two adjacent segments comprise curved segments.

6. A method as defined in claim 1, wherein the constructional element is a tunnel.

7. A constructional element, comprising:

(i) adjacent segments;

(ii) adjacent facing surfaces of said segments;

(iii) a joint which is inherently physically deformable under load between said adjacent segments, said joint comprising a hollow body having a nozzle to permit introduction of a fluid into said hollow body, said joint being adapted to receive a fluid component whereby it is rendered flexible;

(iv) monitoring means for monitoring the pressure of said fluid within said hollow body; and (v) introduction of a flowable settable material when said joint is required to be rendered substantially inflexible.

8. An element as defined in claim 7, wherein said body comprises a plastic material.

9. The element as defined by claim 7, wherein said constructional element is a tunnel.

* * * * *